United States Patent [19]

Krussig

[11] 4,335,672

[45] Jun. 22, 1982

[54] APPARATUS FOR COATING A WEB WITH A VISCOUS COATING MATERIAL

[75] Inventor: Karlheinz F. Krussig, Egelsbach, Fed. Rep. of Germany

[73] Assignee: E. I. Du Pont de Nemours and Company, Wilmington, Del.

[21] Appl. No.: 252,430

[22] Filed: Apr. 9, 1981

[30] Foreign Application Priority Data

Apr. 17, 1980 [DE] Fed. Rep. of Germany ..... 3014816

[51] Int. Cl.[3] ..... C23C 13/08

[52] U.S. Cl. ..... 118/50; 118/410

[58] Field of Search ..... 118/50, 407, 410, 411, 118/412

[56] References Cited

U.S. PATENT DOCUMENTS

| | | | |
|---|---|---|---|
| 2,681,294 | 6/1954 | Beguin | 117/34 |
| 3,502,494 | 3/1970 | Ishiwata et al. | 117/34 |
| 3,735,729 | 5/1973 | Bird | 118/50 |

FOREIGN PATENT DOCUMENTS

| | | |
|---|---|---|
| 1303763 | 10/1972 | Fed. Rep. of Germany . |
| 1160043 | 7/1969 | United Kingdom . |
| 1219224 | 1/1971 | United Kingdom . |

*Primary Examiner*—Bernard D. Pianalto

[57] ABSTRACT

An apparatus for coating a moving web with a viscous coating material using an extrusion coating process includes an extrusion coater, a roller for guiding the web, a suction chamber and a die-shaped exhaust device characterized in that the vacuum in the suction chamber is maintained exclusively by exhaustion through a clearance space defined along the back wall of the suction chamber by means of the die-shaped suction apparatus. The cross-sectional area of the exhaust device is from 0.5 to 50 times that of the cross-sectional area of the die slot formed in the exhaust device divided by twice the number of exhaust openings provided therein.

9 Claims, 3 Drawing Figures

APPARATUS FOR COATING A WEB WITH A VISCOUS COATING MATERIAL

FIELD OF THE INVENTION

This invention relates to an apparatus for coating a moving web with a viscous coating material, such as a photographic gelatin-silver halide emulsion, using an extrusion coating process and, in particular, to a coating apparatus having a suction chamber in proximity to the extrusion coater to prevent the rupturing of a bridge of viscous material formed between the coater and the web.

DESCRIPTION OF THE PRIOR ART

Extrusion coating apparatus for applying viscous photographic gelatin-silver halide emulsion on the surface of a moving web is well-known. Such an extrusion coating apparatus includes an extrusion coater which forms a film of viscous coating material at the exit of an extrusion slot. This film of viscous material is applied directly to the web as the web is guided by a roller to within a predetermined close distance of the extrusion slot.

In another known embodiment using the extrusion coating process the coating material is not directly deposited on the web but is instead guided thereto over an inclined surface. However, in either of these embodiments of the extrusion coating apparatus a bridge of the viscous coating material is formed between the extrusion coater and the moving web.

As the web moves past the extrusion coater at a relatively high speed there has been observed a tendency for the bridge to be torn or ruptured. This has the deleterious effect of leaving gaps in the coating applied to the web.

To counteract this tendency it is the practice in the art to provide a suction chamber next adjacent to the coater in a direction opposite to the direction of movement of the web. The vacuum produced within the suction chamber tends to counteract the force exerted by the movement of the web to thus prevent the bridge from tearing during the coating process.

Exemplary of an exhaustible suction chamber provided for the above-mentioned purpose is U.S. Pat. No. 2,681,294 (Beguin). In the device shown in this patent exhaustion of the air in the chamber occurs at an exhaust opening which is provided in the wall of the suction chamber. The web enters the chamber through a narrow clearance distance defined between the chamber and the web. The presence of the narrow clearance distance is to insure that the web is not scratched. However, the narrow clearance distance makes it difficult to generate and to maintain the vacuum in the suction chamber. In fact, as the air in the suction chamber is exhausted therefrom air streams and vortices are formed in the interior of the chamber as air from outside the chamber flows thereinto through the clearance. These air streams and vortices lead to the disruption of the uniformity of the bridge of coating material and tend to impart an irregular, streaky and striped coating to the web. This is perceived as disadvantageous.

U.S. Pat. No. 3,735,729 (Bird) discloses an exhaustible suction chamber having a first and a second exhaust port. The first exhaust port serves to produce the vacuum in the suction chamber while the second port exhausts the thin air layer carried into the suction chamber through the clearance by the moving web. The second exhaust port is formed as a die slot and extends across the entire width of the coating apparatus. It may be located either within the suction chamber or may be formed in the back wall of the suction chamber. However, because the suction chamber is directly exhausted by the first exhaust port air streams and vortices on the interior of the suction chamber may be formed. Thus, the deleterious results discussed earlier may still be produced using the apparatus disclosed in this patent.

German Pat. No. 1,303,763 discloses a device having a suction chamber for a coating apparatus using the wetting process. In accordance with the device shown in this patent, a second suction chamber is disposed behind a first suction chamber. The exhaust can be located in either the first or the second chamber. This arrangement is useful as providing an insulating vacuum for sealing the coating solution under vacuum used with the wet coating process. However, it is not believed suitable for an extrusion coating process. Additionally, the exhaust does not have a die-shaped cross-section so that air exhaustion from the suction chamber occurs irregularly. Thus, air flows and vortices in the interior of the suction chamber may not be able to be avoided.

In view of the foregoing it is believed advantageous to provide an extrusion coating apparatus including a suction chamber from which the air is withdrawn in a manner which avoids air flows and vortices on the inside thereof.

SUMMARY OF THE INVENTION

In accordance with the instant invention the vacuum in the suction chamber is maintained exclusively by exhaustion of air therefrom through a clearance distance defined between the backwall of the chamber and the web. This is accomplished by the provision of a die-shaped exhaust device behind the suction chamber. The exhaust device includes a die slot through which air withdrawn from the suction chamber enters the exhaust device. The air drawn into the exhaust device is exhausted therefrom through a predetermined number of ports or exhaust openings. The exhaust device is arranged such that the open cross-sectional area thereof is in the range from 0.5 to 50 times (preferably 0.5 to 5 times) that of the cross-sectional area of the die slot divided by twice the number of exhaust openings. To avoid vortices in air flows in the lateral areas of the suction chamber additional die-shaped exhaust devices may be located laterally of the suction chamber. These lateral exhaust devices may be in fluid communication with the interior of the exhaust device or may themselves be provided with separate exhaust openings.

BRIEF DESCRIPTION OF THE DRAWINGS

The invention will be more fully understood from the following detailed description thereof taken in connection with the accompanying drawings, which form a portion of this application and in which.

DESCRIPTION OF THE INVENTION

Figure 1:
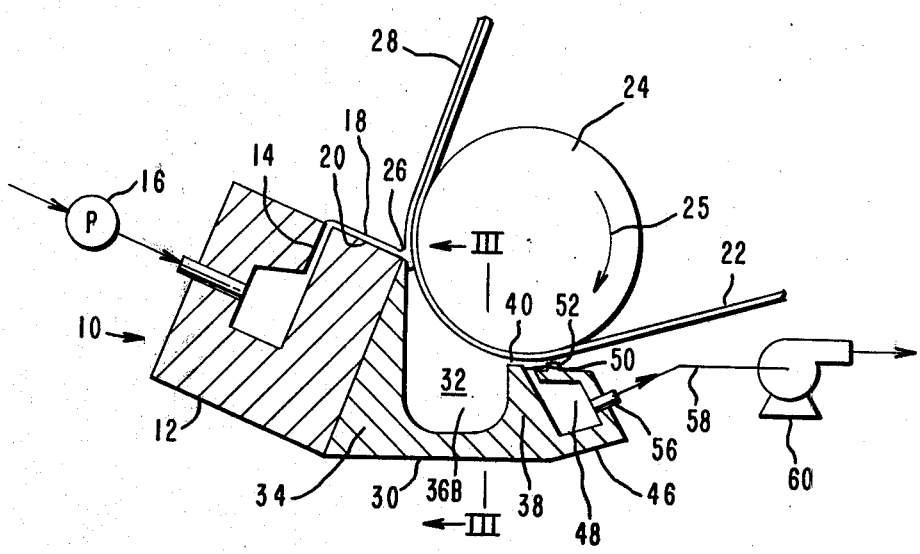
FIG. 1 is a side sectional view through an extrusion coating apparatus in accordance with the present invention taken along section lines I—I in FIG. 3.

Throughout the following description similar reference numerals refer to similar elements in all figures of the drawings.

With reference to FIG. 1 an extrusion coating apparatus generally indicated by reference character 10 includes an extrusion coater, or hopper, 12 having a discharge orifice 14 formed therein. A viscous coating material is pumped under pressure into the coater 12 by a suitable pump 16. A layer 18 of the viscous coating material is extruded from the coater 12 through the discharge orifice 14 and flows down an inclined ramp surface 20.

The coating material 18 is applied to a film support substrate 22 carried on a roller 24. The roller 24 forms means for guiding the substrate 22 in a first direction 25 such that the substrate 22 passes within a predetermined close dimension or gap of the end of the inclined ramp 20. The coating material discharged from the orifice 14 along the surface 20 forms a bridge 26 that spans the gap. As the web 22 moves past the coater 12, the viscous material is taken by the web 22 and a coating 28 thereof is applied across the width of the web 22. Suitable supply and takeup rolls are omitted from FIG. 1 for clarity.

Disposed in next adjacency in a direction opposite the direction of travel of the web 22 is a suction chamber 30. The suction chamber 30 includes an interior region 32 defined by a front wall 34, side walls 36A (FIG. 3) and 36B and a back wall 38. The web 22 enters the suction chamber 30 through a clearance space 40 defined between the top of the back wall 38 and the web 22. The side walls 36 of the suction chamber 30 are configured to conform to the contour of the roller 24. The top edges of the sidewalls 36 are also spaced a predetermined clearance distance 40' (FIG. 3) below the lateral edges of the web 22.

An exhaust device 46 is disposed behind (in the direction of travel of the web 22) the suction chamber 30. The exhaust device is a die-shaped member (FIG. 2) that includes a transversely extending main portion 48 having an elongated die slot 50. The interior of the main portion 48 communicates with the interior region 32 of the suction chamber 30 through the die slot 50 and the clearance space 40. A sealing member 52 is provided on the exhaust device 46 between the top of the rear wall 54 thereof and the web 22. Exhaust ports or openings 56A and 56B are provided to communicate with the interior of the main portion 48 of the exhaust device 46, the openings 56 being connected by suitable lines 58 to a suction pump 60. Although two openings 56 are shown, any predetermined number of exhaust openings may be used.

In operation, the web 22 is guided along the coating roller 24 in the direction 25, past the sealing member 52 mounted on the rear wall 54 of the exhaust device 46 and enters the interior region 32 of the suction chamber 30 through the clearance space 40. The web 22 passes the bead of extruded coating material in the bridge 26 at which point the coating material is applied to the substrate 22. To prevent the bridge 26 from being ruptured by the passage of the web 22, the air within the suction chamber 30 is withdrawn, producing a vacuum in the interior region 32 thereof which draws the bead of coating material in the bridge 26 into the suction chamber 30 in a direction opposed to the direction 25, thus preventing the rupture of the bridge 26.

The vacuum in the suction chamber 30 is produced by withdrawal of the air therefrom by the exhaust device 46. Through the action of the pump 60, air is exhausted from the main portion 48 of the exhaust device 46 through the exhaust openings 56. The air in the interior region 32 of the suction chamber 30 is withdrawn through the clearance space 40 and the die slot 50 into the main portion 48 of the exhaust device 46. Thus, the vacuum in the suction chamber 30 is determined by the volume of air withdrawn therefrom, the width of the die slot 50, the clearance space 40 and the space between the sealing member 52 and the moving web 22. By withdrawing the air from the suction chamber 30 through the clearance space 40, a pressure drop along the clearance space is avoided and the interior region 32 of the suction chamber 30 remains free of vortices and air streams. The exhaust device 46 (and lateral exhaust devices 46' discussed herein) cause the vacuum maintained in the suction chamber 30 to act in a spacial and timely manner constantly on the coating material bridge 26 leading to a uniform coating which is free of coating defects such as streaks or stripes.

Figure 2:
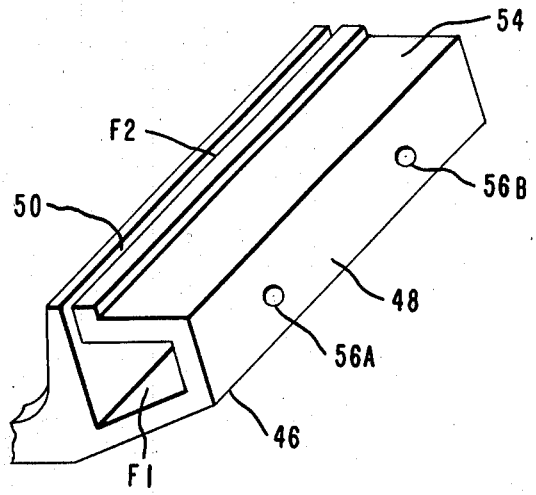
FIG. 2 is an isolated perspective view of a die-shaped exhaust device in accordance with the present invention.

With reference now to FIG. 2 an isolated perspective view of the transverse main portion 48 of the exhaust device 46 is shown. In accordance with this invention the main portion 48 of the exhaust device 46 exhibits an open cross-sectional area indicated by reference character $F_1$ while the open cross-sectional area of the die slot 50 is indicated by the reference character $F_2$. With reference to FIG. 1, the open cross-sectional area $F_1$ lies in the plane of FIG. 1, while the open cross-sectional area $F_2$ of the die slot 50 is transverse to the plane of FIG. 1.

The open cross-sectional area $F_1$ of the main portion 48 of the exhaust device 46 is 0.5 to 50 times that of the open cross-sectional area $F_2$ of the die slot 42 divided by twice the number of exhaust openings 56 provided in the back wall of the suction device 46. Especially good results are obtained when the open cross-sectional area $F_1$ is 0.5 to 5 times that of the open cross-sectional area $F_2$, divided by twice the number of exhaust openings 52. For example, if the dimension of the die slot 42 is 0.5 centimeters and the transverse dimension thereof is 150 centimeters, the cross-sectional area $F_2$ of the die slot is 75 square centimeters and the open cross-sectional area $F_1$ of the exhaust device 46 is fourteen square centimeters. Since there are two exhaust openings 56A and 56B it follows that the open cross-sectional area $F_1$ is 0.75 times the open cross-section area $F_2$ divided by the number of exhaust openings.

The form of the cross-sectional area $F_1$ is not critical to obtain the desired effects. If a favorable form in view of flow technology is selected, the size of the exhaust device 46 is sized to fit within the space available in a given extrusion coating apparatus.

Figure 3:
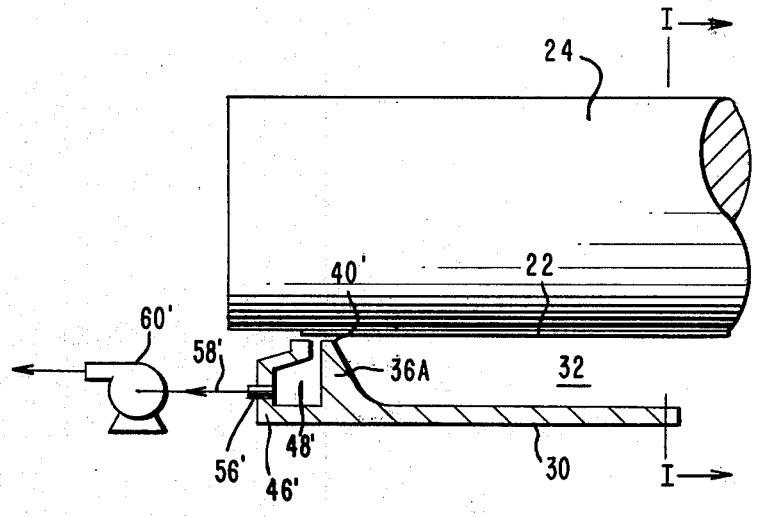
FIG. 3 is a transverse sectional view of the coating apparatus of the present invention taken along section lines III—III in FIG. 1.

In order that vortices and air flows are also avoided in the lateral areas of the suction chamber 30, additional die-shaped exhaust devices, as at 46', may be located along the lateral sidewalls 36 of the suction chamber 30. With reference now to FIG. 3 the additional exhaust devices 46' have internal regions 48' therein which extend laterally of the suction chamber 30. The lateral exhaust devices 46' may be provided with a separate exhaust opening 56' communicating with a suction pump 60' through a suitable line 58'. Alternatively, the interior portions 48' of the lateral exhaust devices 46' may communicate with the main portion 48 of the exhaust device 46 and exhausted therethrough.

Those skilled in the art having benefit of the teachings hereinabove set forth may effect numerous modifications thereto. These modifications are to be construed as lying within the scope of the present invention as defined in the appended claims.

What is claimed is:

1. Apparatus for coating a moving web with a viscous coating material, the apparatus being of the type having an extrusion coater for discharging the coating material onto the web, means for guiding the web in a first direction past the coater such that a bridge of coating material is formed between the web and the coater as the web moves therepast, a suction chamber having a wall disposed within a predetermined clearance distance of the web, the suction chamber being operable to draw the bridge by suction in a direction opposite the first direction to prevent the movement of the web past the coater from rupturing the bridge, wherein the improvement comprises:

a die-shaped exhaust device having a die slot and a predetermined number of exhaust openings therein, the exhaust device generating the suction within the chamber by withdrawing air therefrom through the clearance and the die slot, the air drawn into the exhaust device being exhausted therefrom through the exhaust openings, the cross-sectional area of the exhaust device being from 0.5 to 50 times the cross-sectional area of the die slot divided by twice the number of exhaust openings.

2. Apparatus according to claim 1 wherein the cross-sectional area of the exhaust device is from 0.5 to 5 times the cross-sectional area of the die slot divided by twice the number of exhaust openings.

3. Apparatus according to claims 1 or 2 wherein a second wall of the suction chamber is disposed within a second predetermined clearance distance of the web and wherein the improvement further comprises:

a second die-shaped exhaust device for withdrawing air from the suction chamber through the second clearance distance.

4. Apparatus according to claim 3 wherein the second exhaust device communicates with the first exhaust device.

5. Apparatus according to claim 4 wherein the second exhaust device has an exhaust opening therein and wherein air withdrawn into the second exhaust device is exhausted therefrom through the exhaust opening therein.

6. Apparatus for coating a moving web with a viscous coating solution according to the extrusion coating process, the apparatus comprising an extrusion coater (10), a coating roller (24) for guiding the web, a suction chamber (30) and a die-shaped exhaust device (46)

characterized in that the vacuum in the suction chamber (30) is maintained exclusively by exhaustion through a clearance (40) along a sealing surface defined between the web and a back wall of the suction chamber (30) by means of the die-shaped suction apparatus (46), and that the open cross-sectional area ($F_1$) of the exhaust device is 0.5 to 50 times the open cross-sectional area ($F_2$) of the die slot (50) divided by twice the number of the suction openings (56).

7. Apparatus according to claim 6 characterized in that the open cross-sectional area $F_1$ is 0.5 to 5 times that of the open cross-sectional area $F_2$ divided by twice the number of the exhaust openings (56).

8. Apparatus according to claims 6 or 7 characterized in that a lateral die-shaped exhaust device (46') is located also along the side walls of the suction chamber (30).

9. Apparatus according to claim 8 characterized in that the lateral die-shaped exhaust device (46') is connected to the die-shaped exhaust device (46) and that the lateral exhaust device 46' is exhausted at separate exhaust openings (56').

* * * * *